United States Patent [19]

Doyel

[11] 4,365,434

[45] Dec. 28, 1982

[54] DISPLAY STAND FOR SHEET MATERIAL SUCH AS PHOTOGRAPHS

[76] Inventor: John S. Doyel, 404 W. 20th St., New York, N.Y. 10011

[21] Appl. No.: 313,745

[22] Filed: Oct. 22, 1981

[51] Int. Cl.[3] ..... G09F 19/00

[52] U.S. Cl. ..... 40/530; 281/25 A; 402/31; 40/119

[58] Field of Search ..... 402/4, 31, 75; 281/25 A; 40/530, 119, 120, 377, 382

[56] References Cited

U.S. PATENT DOCUMENTS

| | | | |
|---|---|---|---|
| 405,160 | 6/1899 | Hamilton | 40/119 X |
| 1,399,880 | 12/1921 | Reed | 40/119 |
| 2,083,703 | 6/1937 | Grumbacher | 281/25 A |
| 3,090,143 | 5/1963 | Arnold | 40/119 |
| 3,218,743 | 11/1965 | Shneider | 40/530 |
| 3,387,395 | 6/1968 | Merrit | 40/530 |
| 4,041,627 | 8/1977 | Lyman | 40/530 |

*Primary Examiner*—Gene Mancene
*Assistant Examiner*—Wenceslao J. Contreras
*Attorney, Agent, or Firm*—Cooper, Dunham, Clark, Griffin & Moran

[57] ABSTRACT

Disclosed is a display stand with split rings supporting sheet material such as photographs, recipes, instructions, addresses, etc. The stand is made entirely of integrally molded plastic components snap-locked to each other through hand assembly. The rings are deformed by hand to load them with sheet material; when released the ring ends are supported by the rest of the stand so that the weight of the sheet material threaded on the rings does not deform them.

4 Claims, 5 Drawing Figures

Fig. 1.
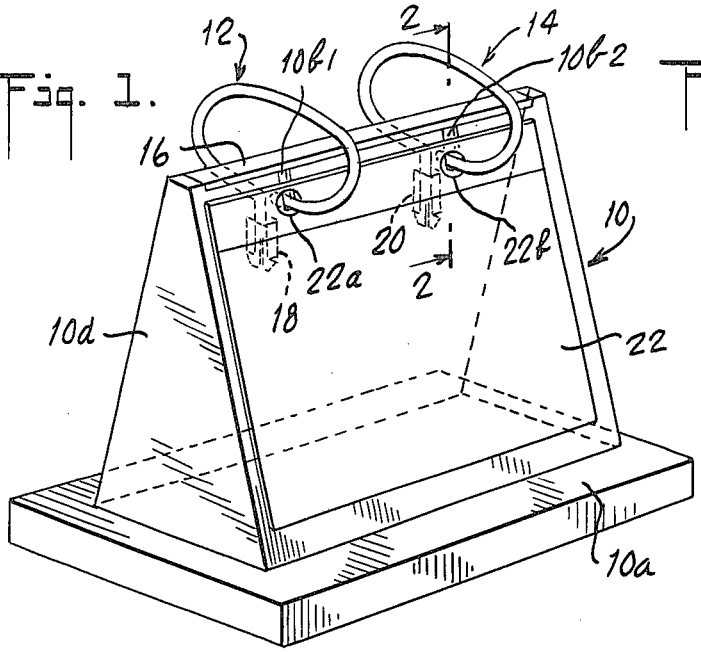
Fig. 5.
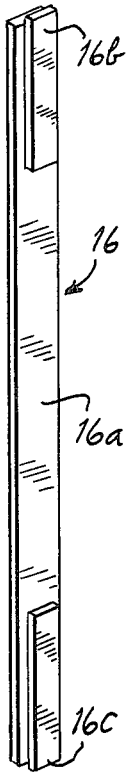
Fig. 2.
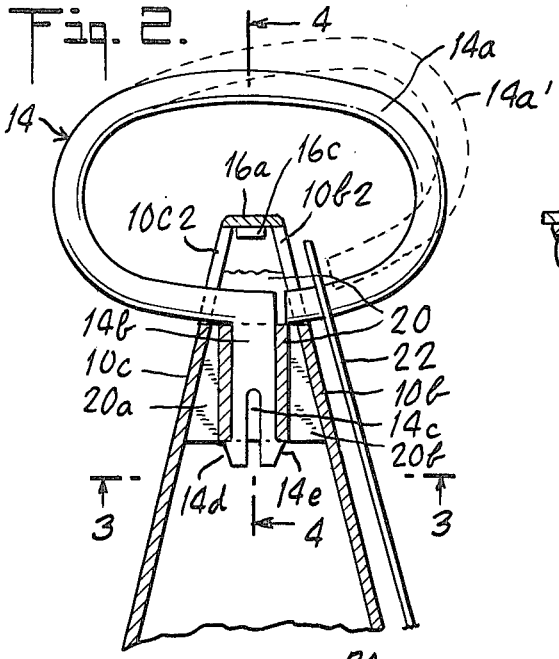
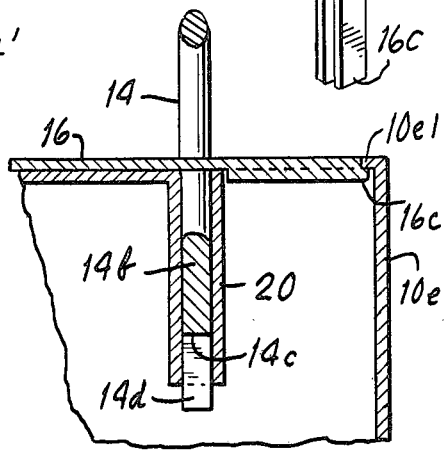
Fig. 4.
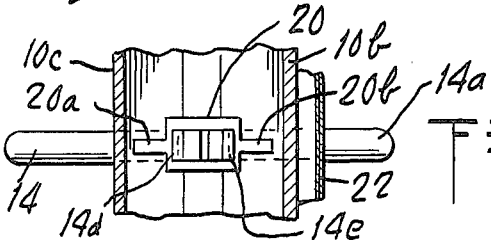
Fig. 3.

DISPLAY STAND FOR SHEET MATERIAL SUCH AS PHOTOGRAPHS

BACKGROUND AND SUMMARY OF THE INVENTION

The invention is in the field of display stands for sheet material such as photographs, recipes, instructions, addresses, etc. An object is to provide a stand which is particularly inexpensive to manufacture and assemble but is sturdy and convenient to use. Stands of this general type are proposed, for example, in U.S. Pat. Nos. 1,711,070; 2,589,383; 2,945,594 and 3,218,743, but appear to be more expensive to make and to have less sturdy and convenient construction than is made possible by this invention.

An exemplary embodiment of the invention comprises a display stand having a base and a front and a back wall which slant toward each other in extending upwardly from the base and are integrally formed therewith from molded plastic material. Each wall has at its top edge a pair of spaced apart, open top notches aligned with those of the other wall. An open sleeve extends downwardly from each respective aligned pair of said notches and is located between said walls and secured thereto, preferably by being integrally molded therewith. The sheet material is held by a pair of ring members each made of integrally molded resilient plastic material and comprising an oval ring and a post which extends away from the ring along the short diameter thereof. Each ring is split at one side of its post, and each post is shaped and dimensioned to fit within its respective sleeve, with the connected end of each ring resting on its respective notch in the back wall and the free end of each ring resting on its respective notch in the front wall. Sheets such as photographs, transparent envelopes, or the like are loaded onto the display stand by pulling the rings apart until the free end of each clears the front wall, at which time the sheet or sheets having matching holes along a margin thereof are slid between the front wall and the free ring ends to align the holes with the free ring ends, and the rings are released to have the free ends thereof spring back and go through the sheet holes and come to rest on the notches in the front wall. The front and back walls can be connected to each other by side walls extending upwardly from the base and integrally formed together with the base and front and back walls. The top edges of the front and back walls can be covered by a snap lid of plastic material snap-locked to extensions of the side walls. Portions of the rings which are adjacent the post can be made substantially straight, or can have reduced curvature as compared to the remainder of the ring, to prevent excessive stagger in a stack of sheets loaded onto the stand. One or both of the posts and sleeves can have engaging means snap-locking them to each other as the posts are pushed down into the sleeves in assembling the stand.

In a particular embodiment the stand comprises only four parts which are easily assembled by hand: the unit made up of the base and front, back and side walls and sleeves, the two ring members, and the snap lid covering the top edges of the front and back walls. The stand is assembled by pushing the posts into the sleeves until they snap-lock to each other and snap-locking the snap lid at the top edges of the walls.

BRIEF DESCRIPTION OF THE DRAWINGS

FIG. 1 is a perspective view of a display stand embodying the invention.

FIG. 2 is a partial sectional view taken along line 2—2 of FIG. 1.

FIG. 3 is a partial sectional view taken along line 3—3 of FIG. 2.

FIG. 4 is a partial sectional view taken along line 4—4 of FIG. 2.

FIG. 5 is a perspective view of a snap lid forming a part of the stand.

DETAILED DESCRIPTION OF AN EXEMPLARY EMBODIMENT

The display stand comprises a unitary, integrally molded structure generally indicated at 10, a pair of ring members 12 and 14 and a snap lid 16. The unitary structure 10 comprises a base 10*a*, a front wall 10*b* and a back wall 10*c*, a left wall 10*d* and a right wall 10*e*, and a pair of sleeves 18 and 20. Front wall 10*b* has a pair of spaced apart, open top notches 10*b*1 and 10*b*2 aligned with similar notches 10*c*1 (not seen) and 10*c*2 in back wall 10*c*. Ring member 14 is integrally molded of resilient plastic material and comprises an oval ring 14*a* and a post 14*b* which extends away from ring 14*a* along the short diameter thereof (but can be somewhat offset from said short diameter). The post 14*b* is dimensioned and shaped to fit within sleeve 20, and its lower end is bifurcated by a slit 14*c* and has a pair of snap-lock barbs 14*d* and 14*e* which engage the lower edges of sleeve 20 and hold ring member 14 in place once its post is pushed down into the sleeve. Ring member 12 is identical to ring member 14 and fits within sleeve 18 which is identical to sleeve 20 and is positioned relative to notches 10*b*1 and 10*c*1 in the same manner as sleeve 20 is positioned with respect to notches 10*b*2 and 10*c*2. Sleeve 20 is retangular and is attached to front wall 10*b* and back wall 10*c* by respective integral ribs 20*a* and 20*b*. Sleeve 18 is attached in the identical manner. Snap lid 16 comprises a strip 16*a* and a pair of integrally formed snap-lock lips 16*b* and 16*c*. Lip 16*c* interlocks with an extension 10*e*1 of side wall 10*e* and lip 16*b* interlocks in the same manner with a corresponding extension of side wall 10*d* such that strip 16*a* is flush with said extensions of side walls 10*d* and 10*e* and covers the top edges of front wall 10*b* and back wall 10*c*.

The display stand is easily assembled by hand from the molded pieces 10, 12, 14 and 16 by forcing the posts of ring members 12 and 14 down the respective sleeves 18 and 20 until the posts snap-lock with the sleeves, and then threading snap lid 16 through the rings, bending it to insert the lips 16*b* and 16*c* under the respective extensions of side walls 10*d* and 10*e* and pushing it down until it is flush therewith and covers the top edges of front and back walls 10*b* and 10*c*.

Sheets such as photographs, transparent envelope or the like, designated 22 are loaded onto the display stand by pulling ring members 12 and 14 apart until each assumes the shape shown in dotted lines at 14*a*′ in FIG. 2, aligning punch holes 22*a* and 22*b* in sheet 22 with notches 10*b*1 and 10*b*2 and then releasing the rings to allow each to snap back to the solid line position shown for ring 14*a* in FIG. 2.

Note that both free ends of rings 12*a* and 14*a* rest on notches 10*b*1 and 10*b*2 in front wall 10*b*, whereby the weight of sheets 22 on said free ends of rings 12*a* and 14*a* is taken directly by the unit 10, and cannot undesirably deform rings 12*a* and 14*a*, and that this dispenses with the need to have the rings strong enough to directly support the entire weight of sheet material threaded thereon. Note also that the portions of the rings on one or both sides of their respective posts can be substantially straight, or at least of less curvature than the remainder of the rings, to thereby prevent or reduce excessive stagger in a stack of sheets 22 threaded thereon.

Unit 10 and snap lid 16 can be made of transparent or opaque plastic material such as, without limitation, ABS and Lexan, etc., and rings 12 and 14 can be made of plastic material such as, without limitation, nylon.

Unit 10 and lid 16 are symmetrical about the plane in which the sectional view of FIG. 4 is taken; thus either of walls 10*b* and 10*c* can be a front wall depending on which way the split in rings 12*a* and 14*a* faces.

Many variations within the scope of the invention will occur to the skilled artisan who becomes acquainted with the disclosure herein and, accordingly, the scope of the invention is limited only by the appended claims and is not limited to the specific exemplary embodiment described in detail above.

What I claim is:

1. A display stand for sheet material such as photographs comprising:

a base and a front and a back wall which slant toward each other in extending upwardly from the base and are integrally formed therewith from molded plastic material, each wall having at its top edge a pair of spaced-apart, open top notches aligned with those of the other wall;

a pair of open sleeves each extending downwardly from a respective aligned pair of said notches and located between said walls and secured thereto;

a pair of ring members each made of integrally molded resilient plastic material and comprising an oval ring and a post which extends away from the ring along the short diameter thereof, said ring being split at one side of the post and each post being shaped and dimensioned to fit within a respective one of said sleeves, with the connected end of the ring resting on the respective notch in the back wall and the free end of the ring resting on the respective notch in the front wall;

whereby sheets such as photographs, cards, transparent envelopes or the like which have at a margin thereof a pair of holes aligned with said ring can be loaded onto the display stand by pulling the side of the ring which has the free end thereof away from the adjacent wall and then allowing said free ends to snap back through said holes.

2. A display stand as in claim 1 in which a portion of each ring at least on one side of the respective post has a curvature substantially less than the remainder of the ring to prevent or reduce excessive stagger in a stack of sheets threaded on the rings.

3. A display stand as in claim 1 including side walls whcih extend upwardly from said base and connects at front and back walls and are integrally molded with said base and front and back walls, and a snap lid covering the top edges of said front and back walls and interlocking with said side walls to form a flush top surface extending within said rings and from the outside surface of one of said side walls to that of the other.

4. A display stand as in claim 1, 2 or 3 wherein at least one of said posts and sleeves includes locking means to snap-lock the post to the respective sleeve as the post is pushed down the sleeve.

* * * * *